United States Patent [19]

Mowry

[11] Patent Number: 4,781,668

[45] Date of Patent: Nov. 1, 1988

[54] CUTTING DEVICE FOR A CORRUGATED BOX MACHINE

[75] Inventor: Donald E. Mowry, Norwalk, Ohio

[73] Assignee: Don Mowry Flexo, Inc., Norwalk, Ohio

[21] Appl. No.: 925,062

[22] Filed: Oct. 30, 1986

[51] Int. Cl.[4] ..... B26D 1/24

[52] U.S. Cl. ..... 493/365; 83/498; 83/499; 83/508.3; 83/665; 83/700; 493/366

[58] Field of Search ..... 83/498, 499, 504, 508.3, 83/481, 482, 508.2, 699, 700, 665, 676; 493/60, 365, 366, 367, 368

[56] References Cited

U.S. PATENT DOCUMENTS

| | | | |
|---|---|---|---|
| 301,905 | 7/1884 | Lytle | 83/665 |
| 2,888,076 | 5/1959 | Lanstrom | 83/665 |
| 3,302,506 | 2/1967 | Turner et al. | 83/665 |
| 4,215,609 | 8/1980 | Coburn et al. | 83/499 X |
| 4,572,047 | 2/1986 | Punater et al. | 83/508.2 X |

*Primary Examiner*—Frank T. Yost

*Attorney, Agent, or Firm*—Emch, Schaffer, Schaub & Porcello Co.

[57] ABSTRACT

A cutting device for a cutting machine for use in the corrugated box industry is disclosed. Cooperating rollers or heads are positioned on opposed rotatable shafts. The heads are disposed for cutting or scoring material passed through the heads. A hub assembly is connected to each of the heads for releasably securing the heads to the shaft. The hub assembly is resiliently biased in a manner to secure the rollers on the shaft. A rotatable cam is positioned adjacent the hub assembly. The rotatable cam is rotatable to engage and move the hub assembly in a manner whereby the hub assembly disengages from the shaft and allows the heads to be moved along the shaft to a new position.

18 Claims, 6 Drawing Sheets

CUTTING DEVICE FOR A CORRUGATED BOX MACHINE

BACKGROUND OF THE INVENTION

The invention relates to a cutting device that is utilized for corrugated containers. More particularly, the invention is directed to a cutting device where the heads or rollers are moveable to accommodate different size containers and containers requiring cuts in different locations.

Cutting machines are utilized to make the cuts or scores in various size boxes and boxes requiring handles and carrying holes positioned in different locations. As the size of the box and the requirements of the cuts or scores change, the position of the cooperating heads must be changed on the shafts. In the past, heads or rollers have often been held in position by set screws or bolts that hold the heads in position. To reposition the heads it is necessary to stop the machine and have operators manually release the set screws or bolts so that the cooperating heads can be manually repositioned. A great deal of manual labor is required in this operation as each head must be loosened, repositioned and then tightened so that the head is securely held in the new position on the shafts. In other prior art devices pads or yokes move the cutting heads sideways. Usually there are several cooperating heads located in the cutting machine and each of these must be individually repositioned to accommodate different size boxes.

It is an object of the present invention to provide an automatic release mechanism for the cooperating heads of a cutting machine that is used in the corrugated box industry.

It is a further object of the invention to provide a drive mechanism for repositioning the cooperating heads on the rotating shafts of the cutting machine.

Further objects and advantages of the invention will be readily understood by reading the following description in connection with the attached drawings.

SUMMARY OF THE INVENTION

A cutting device for the corrugated box industry having opposed rotatable shafts is disclosed. Cutting and cooperating heads or rollers are positioned on the shafts. The heads are disposed for cutting or scoring material passed through the heads. A hub assembly is connected to the cooperating heads and is positioned on the rotatable shaft for releasably securing the heads to the shaft. The hub assembly is resiliently biased in a manner to secure the cooperating heads on the shaft. A rotatable cam is positioned adjacent the hub assembly. The rotatable cam is rotatable to engage and move the hub assembly in a manner whereby the hub assembly disengages from the shaft and allows the cooperating heads to be moved along the shaft to a new position.

DESCRIPTION OF THE PREFERRED EMBODIMENT

Figure 1:
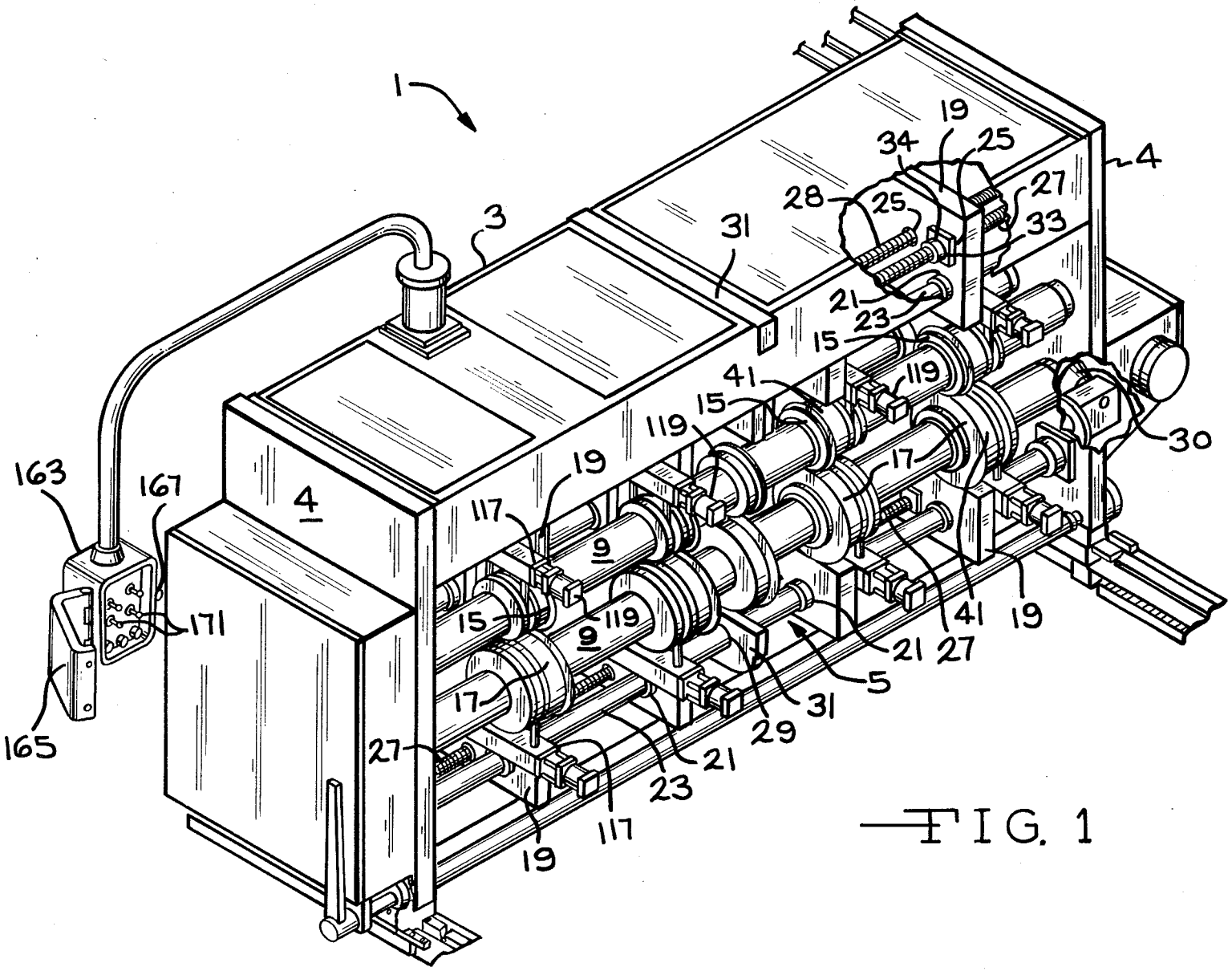
FIG. 1 is a perspective view of a cutting or scoring device according to the present invention.

This invention relates to a cutting or scoring device that is utilized with corrugated containers. Particularly the invention is directed to a cutting device where the cutting heads or rollers are moveable to accommodate different size containers and containers requiring cuts or scores in different locations. The features of the invention will be more fully understood by referring to the attached drawings in connection with the following description.

The cutting device 1 has a outer housing 3 that encloses the cutting mechanism 5. Positioned on the interior of the outer housing 3 are two rotatable shafts 9 that are in substantially parallel relationship. The rotatable shafts 9 are rotatably mounted in bearings located in the end walls 4 of the outer housing 3. A plurality of moveable cutting rollers or heads 15 are positioned on one rotatable shaft 9. A plurality of cooperating moveable mating rollers or heads 17 are positioned on the other rotatable shaft 9. The moveable cutting heads 15 and moveable mating heads 17 extend from the shafts 9 in a direction that is substantially perpendicular to the longitudinal axis of the shafts 9. Each moveable cutting head 15 is positioned to engage a moveable mating head 17 so that the cooperating cutting heads 15 and mating heads 17 will produce a cut or score in the corrugated material that is passed between these heads. It is understood that the position of the cutting heads 15 and the mating heads 17 may be interchanged from one shaft to another and still be within the scope of the present invention.

A moveable flange 19 is positioned adjacent each moveable cutting head 15 and each moveable cooperating head 17. A passageway 21 is defined in each of the moveable flanges 19. A support rod 23 extends through the passageways 21 in the moveable flanges 19. The support rod 23 extends between the end walls 4 of the outer housing 3 and the support rod is positioned in substantially parallel relationship to the rotatable shafts 9. The moveable flanges 19 are moveably supported on the support rod 23. The moveable flanges 19 are disposed substantially perpendicular to the longitudinal axis of the support rod 23 and the flanges 19 move in a direction along the longitudinal axis of the support rod. There is a support rod 23 for the moveable flanges 19 supporting the cutting heads 15 and a support rod 23 for the moveable flanges 19 supporting the cooperating heads 17. The support rods 23 are positioned in adjacent spaced apart relationship to the rotatable shafts 9. Although only one support rod 23 is shown supporting each set of flanges, it should be understood that additional support rods could be utilized if necessary to provide the additional support for the moveable flanges 19.

Plates 31 are positioned substantially in the center of the top and bottom of the outer housing 3. The plates 31 extend into the interior of the outer housing. The plate 31 extending from the top of the outer housing terminates in adjacent spaced apart relationship to the rotatable shaft 9 adjacent the cutting heads 15. The plate extending from the bottom of the outer housing terminates in adjacent spaced apart relationship to the rotatable shaft 9 adjacent the cooperating heads 17. The plates 31 are disposed substantially perpendicular to the longitudinal axis of the rotatable shafts. The plates 31 divide the outer housing two seperate halves. A passageway 29 is located in each of the plates 31 for rotatably supporting the rods 23. A first threaded rod 27 and a second threaded rod 28 extend from the plate 31 to the end walls 4 of the outer housing 3. There is a first threaded rod 27 and a second threaded rod 28 positioned above the moveable cutting heads 15 on each side of the plate 31. There is also a first threaded rod 27 and second threaded rod 28 located beneath the moveable cooperating heads 17 on each side of the lower plate 31. The first and second threaded rods 27,28 are rotatably journaled in the plate 31 and the end walls 4 of the outer housing 3. The first and second threaded rods 27,28 are operatively connected to individual motor means 30 that can cause the first and second threaded rods to rotate. It should be understood that different motors and interconnections can be used to rotate the first and second rods. Each moveable flange 19 has two additional apertures 25. The first threaded rod 27 passes through one of the apertures 25 and the second threaded rod 28 passes through the other aperture 25. A plate 33 is positioned on the moveable flange 19 in cooperation with one of the apertures 25. The plate 33 has a threaded collar 34 that engages either the first or second threaded rod 27, 28. If the plate 33 is positioned to engage the first threaded rod 27 that passes through the moveable flange 19 for a cutting heads 15 the plate 33 on the moveable flange 19 for the cooperating heads 17 will also engage the first threaded rod 27. On the moveable flanges 19 for the adjacent cutting head 15 and cooperating head 17 the plate 33 will be disposed to engage the second threaded rod 28. Thus, the first threaded rod 27 will be operatively connected to moveable flanges 19 that control the positioning of one cutting head 15 and one cooperating head 17. The second threaded rod 28 will be positioned to control an adjacent pair of moveable flanges 19 and another cutting head 15 and cooperating head 17. Accordingly, the first threaded rod 27 and second threaded rod 28 will be able to control the movement of the moveable cutting heads 15 and moveable cooperating heads 17 that are located on each side of the cutting device 1.

Figure 5:
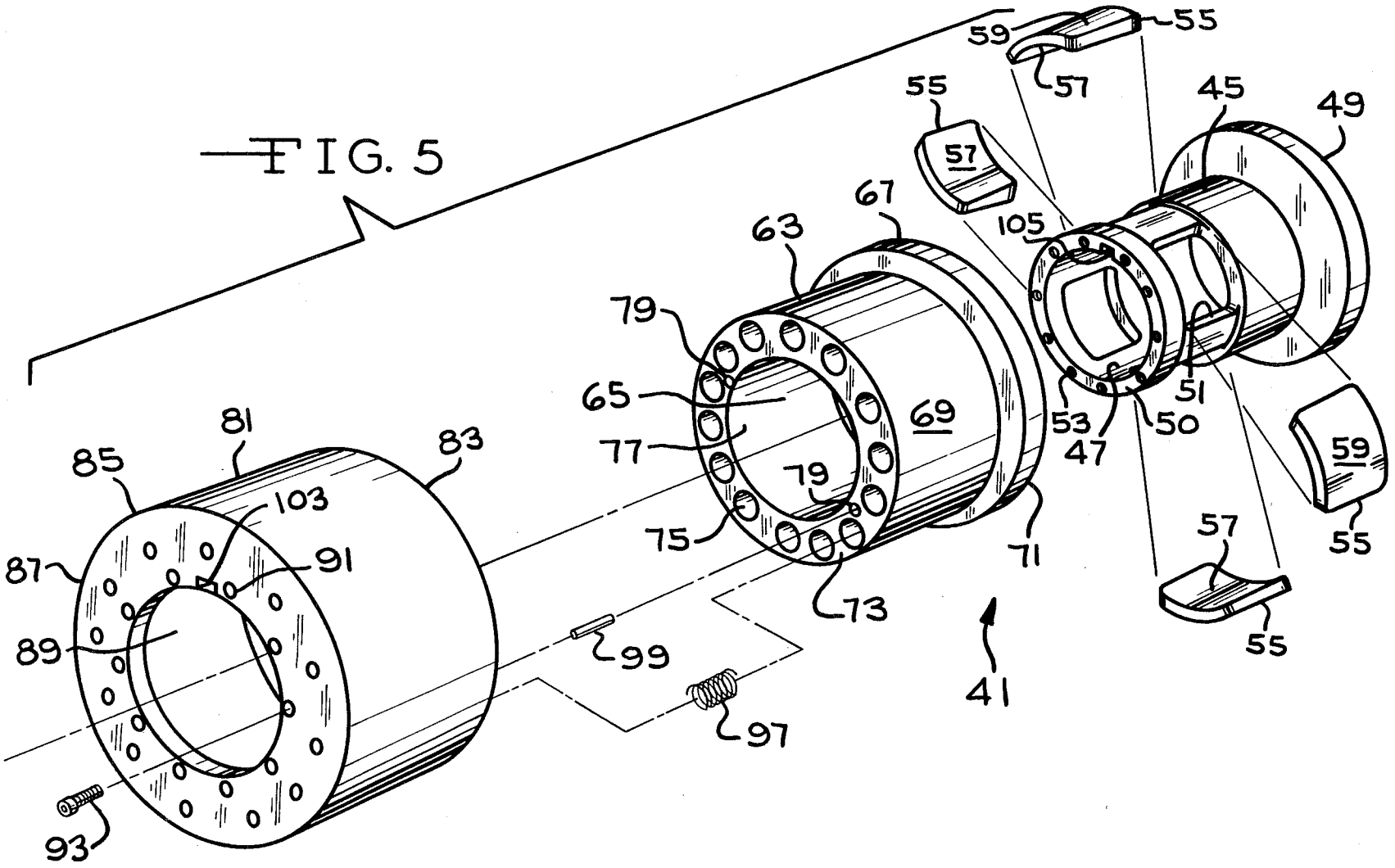
FIG. 5 is an exploded perspective view of a portion of the cutting device.

Referring to FIG. 5, each cutting head 15 and each cooperating head 17 has a hub assembly 41 that secures the heads or rollers to their respective rotatable shafts 9. The hub assembly 41 has a cylindrical sleeve 45 which defines a center aperture 47. The center aperture 47 is designed to slideably receive the rotatable shaft 9. A circular flange 49 is positioned at one end of the cylindrical sleeve 45. The circular flange 49 extends from the cylindrical sleeve in a direction that is substantially perpendicular to the longitudinal axis of the center aperture that passes through the cylindrical sleeve. A mounting flange 50 is positioned on the other end of the cylindrical sleeve 45. A plurality of threaded passageways 53 are positioned around the periphery of the mounting flange 50. The passageways 53 are disposed substantially parallel to the longitudinal axis of the center aperture 47. A plurality of openings 51 are positioned radially around the cylindrical sleeve 45. The openings extend through the sidewalls of the cylindrical sleeve into the center aperture 47. A wedge member 55 is positioned in each of the openings 51. The wedge members 55 are arcuate in shape and substantially fill the openings 51 defined in the cylindrical sleeve 45. The interior surface 57 of the wedge member 55 is designed to engage the surface of the shaft passing through the center aperture 47 of the cylindrical sleeve 45. The wedge members 55 have a tapered cross-section in a direction taken along the longitudinal axis of the center aperture 47. This tapered cross-section is designed so that the wedge members 55 have the greatest thickness on the end that is closest to the circular flange 49. The wedge members are thinnest on the side of the wedge member that is closest to the mounting flange 50 positioned on the end of the cylindrical sleeve 45.

A cylindrical drum 63 having a center passageway 65 is moveably positioned concentrically around the cylindrical sleeve 45. The cylindrical drum 63 has a first end 71 and a second end 73. The cylindrical drum 63 has a circular ring 67 positioned on an outer surface 69 of the cylindrical drum 63. The circular ring 67 is positioned adjacent the first end 71 of the cylindrical drum 63. The circular ring 67 extends away from the outer surface 69 in a direction that is substantially perpendicular to the longitudinal axis of the center passageway 65. The second end 73 of the cylindrical drum 63 contains a plurality of passageways 75 that extend into the cylindrical drum 63 for a short distance. The interior surface 77 of the cylindrical drum 63 converges towards the cylindrical sleeve 45 when moving in an axial direction from the first end 71 towards the second end 73. That is that the diameter of the center passageway 65 is largest adjacent the first end 71 and progressively decreases in moving axially along the interior surface until the second end 73 of the cylindrical drum 63 is reached. Accordingly, the second end 73 of the cylindrical drum 63 is closer to the cylindrical sleeve 45 than the first end 71 of the cylindrical drum 63. The interior surface 77 is disposed to engage the outer surface 59 of the wedge members 55. The cylindrical drum 63 is moveably positioned around the cylindrical sleeve 45.

A hollow cylindrical cover 81 is positioned around the cylindrical drum 63. The cylindrical cover 81 has a first end 83 and a second end 85. The first end 83 is open to receive the cylindrical drum 63. The second end 85 has a face plate 87. The face plate 87 extends radially inwardly from the outer surface of the cylindrical cover 81. A bore 89 is disposed substantially in the center of the face plate 87 and the bore 89 is large enough to receive the rotatable shaft 9. A plurality of holes 91 are positioned in the face plate 87. The holes 91 are disposed to be in alignment with the threaded passageways 53 in the mounting flange 50 of cylindrical sleeve 45. A plurality of bolts 93 can be positioned to pass through the holes 91 and to threadingly engage the passageway 53 in the cylindrical sleeve 45 to secure the cylindrical cover 81 and the cylindrical drum 63 to the cylindrical sleeve 45.

A plurality of springs 97 are positioned in the passageways 75 in the second end 73 of the cylindrical drum 63. The springs extend from the passageway 75 and engage the face plate 87 on the cylindrical cover 81.

The springs 97 act against the cylindrical drum and bias the cylindrical drum 63 towards the circular flange 49 on the cylindrical sleeve 45. Guide pins 99 are slideably positioned in guide apertures 79 located on the second end 73 of the cylindrical drum 63. The guide pins 99 engage the face plate 87 on the cylindrical cover 81. The guide pins 99 act to keep the cylindrical drum 63 from rotating relative to the cylindrical sleeve 45 or the cylindrical cover 81. However, the guide pins 99 do not prevent the cylindrical drum 63 from moving in an axial direction.

Figure 2:
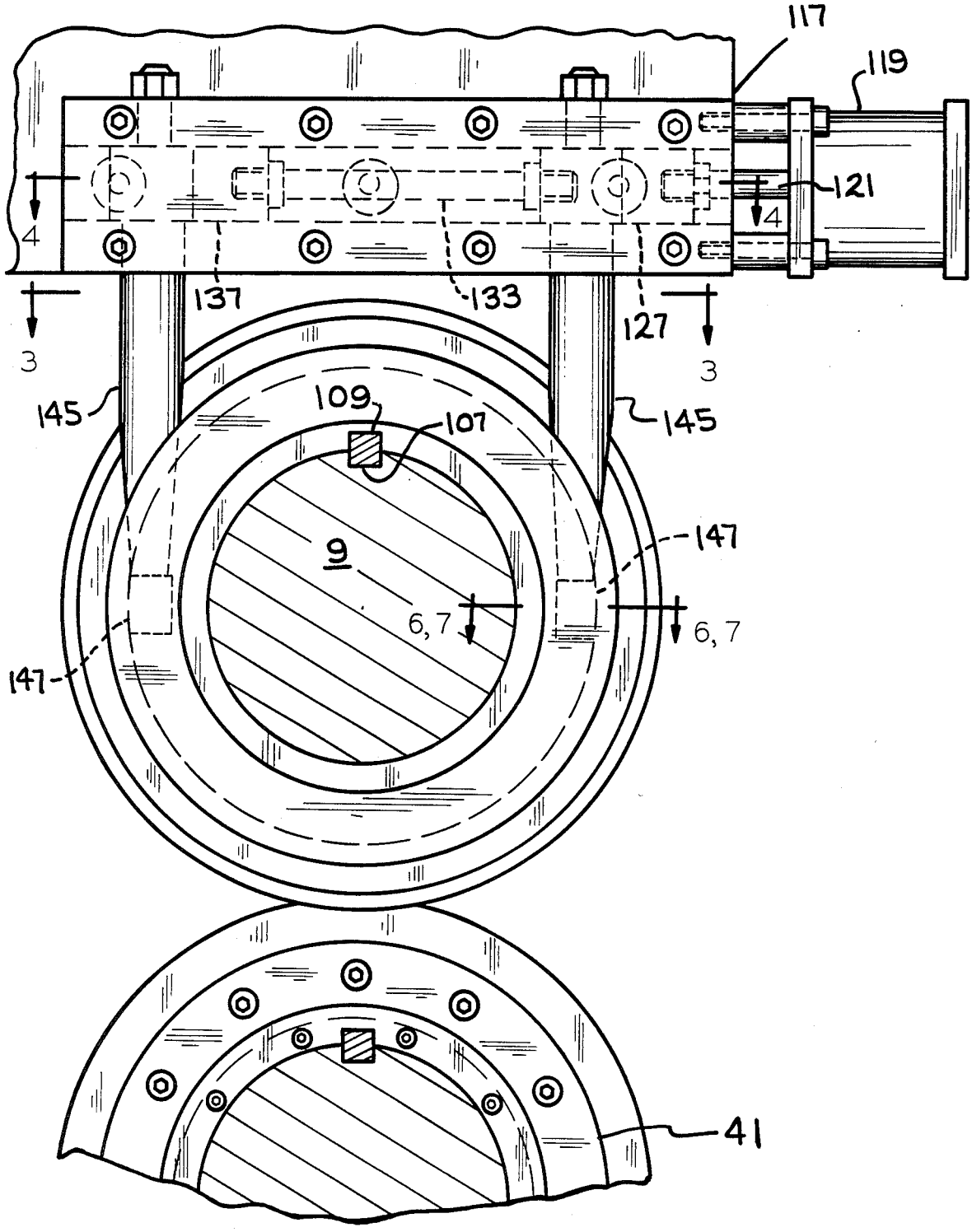
FIG. 2 is a partial cross-sectional view of a portion of the cutting device.
Figure 4:
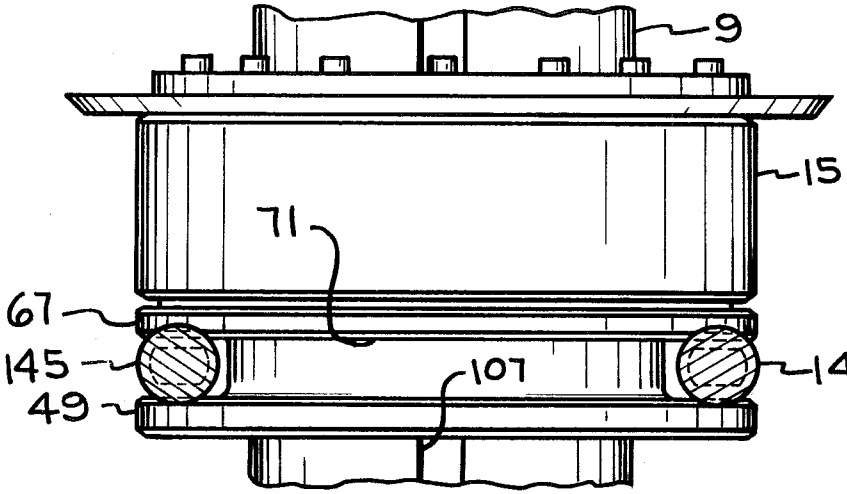
FIG. 4 is a cross-sectional view taken along line 4—4 in FIG. 2.

A keyway 103 is located in the face plate 87 of the cylindrical cover 81. A corresponding keyway 105 is located on the mounting flange 50 of the cylindrical sleeve 45. A shaft keyway 107 is located on the rotatable shafts 9 and the shaft keyway 107 (see FIG. 4) is disposed to be in alignment with the keyway 103 and the keyway 105. A key 109 (see FIG. 2) is positioned in the shaft keyway 107, in the cooperating keyways 103 in the face plate 87 and the keyway 105 in the mounting flange 50. The key 109 acts to prevent the cylindrical sleeve 45 and the cylindrical cover 81 from rotating relative to the rotatable shafts. However, the key 109 and the cooperating keyways do not prevent the cylindrical sleeve 45 or the cylindrical cover 81 from moving axially along the rotatable shafts 9.

Figure 3:
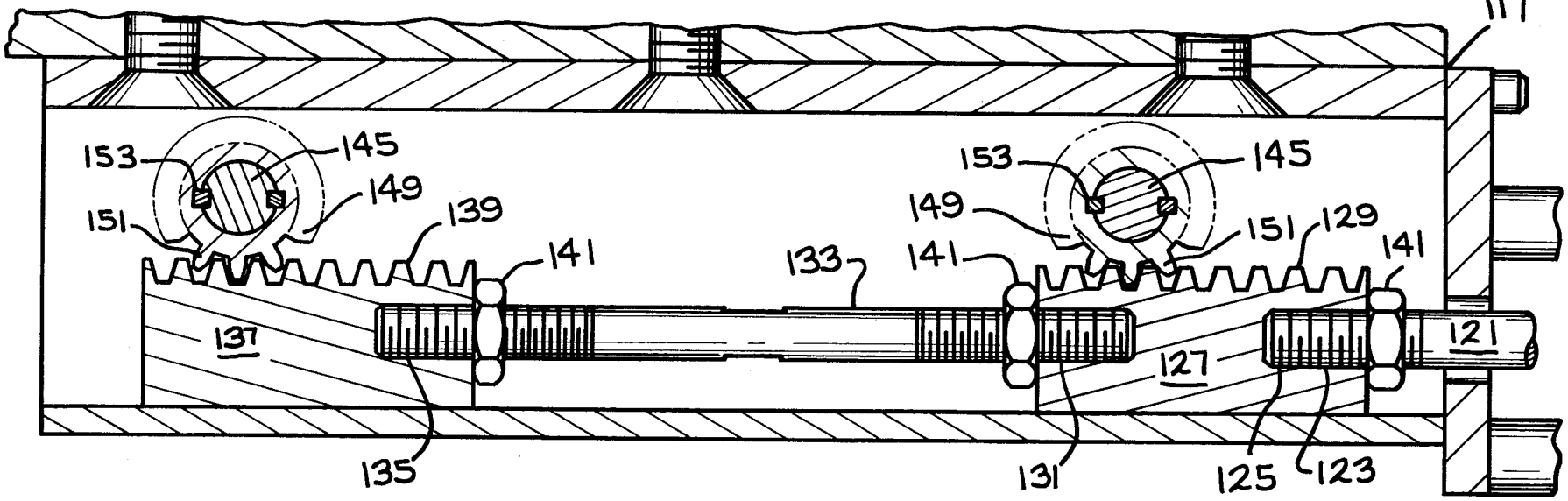
FIG. 3 is a cross-sectional view taken along line 3—3 in FIG. 2.

Mounted on each moveable flange 19 is a release mechanism 117 (see FIG. 3) that controls the positioning of the moveable cutting heads or rollers 15 and the moveable cooperating heads or rollers 17 on the rotatable shafts 9. The release mechanism has a pneumatic cylinder 119 having a rod 121. The end of the rod 121 includes a threaded portion 123. The threaded portion 123 of the rod 121 engages a threaded aperture 125 in a first gear rack 127. The first gear rack 127 has a plurality of gear teeth 129 positioned on one side of the gear rack. The end of the gear rack 127 that is spaced apart from the rod 121 contains a second threaded aperture 131. A threaded rod 133 is positioned with one end in the second threaded aperture 131. The opposite end of the threaded rod 133 is positioned in a threaded aperture 135 located in a second gear rack 137. The second gear rack 137 has a plurality of gear teeth 139 located along one side of the gear rack. Lock nuts 141 are positioned on each end of the threaded rod 133 and on the threaded portion 123 of the rod 121 to secure the position of the threaded rod 133 and the rod 121 relative to the first and second gear racks 127, 137.

Rotatable members 145 are positioned adjacent the gear teeth 129 on the first gear rack 127 and adjacent the gear teeth 139 on the second gear rack 137. A gear 149 is positioned on the end of each rotatable member 145 and has a plurality of gear teeth 151. The partial gears 149 are disposed on the rotatable members 145 so that the gear teeth 151 on one partial gear 149 will engage the teeth 129 on the first gear rack 127 and the gear teeth 151 on the other partial gear 149 will engage the gear teeth 139 on the second gear rack 137. The partial gears 149 are secured to the rotatable members 145 by keys 153 or other suitable securement means. The gear teeth 151 on the partial gears 149 are positioned so that the rotatable members 145 can rotable approximately 90° in one direction and 90° in the opposite direction from the initial starting point shown in FIG. 3. However, the rod 121 of the pneumatic cylinder 119 advances so that the rotatable members 145 are rotated only 90° from the starting position shown in FIG. 3. The rod 121 then returns to the initial position and the rotatable members 145 are rotated back 90° to the starting position shown in FIG. 3. The rotatable members 145 extend from the release mechanism 117 in a direction towards the hub assemblies 41. The rotatable members 145 extend between the circular flange 49 located on the cylindrical sleeve 45 and the circular ring 67 located on the cylindrical drum 63. The rotatable members 145 are positioned so that there is a rotatable member on each side of the hub 41. An end portion 147 of the rotatable members 145 that extends between the circular flange 49 in the circular ring 67 defines a substantially rectangular rotary cam. When the substantially rectangular cam 147 is in the position shown in FIG. 6, the cam surface does not contact the circular flange 49 or the circular ring 67. However, when the rotatable member 145 is rotated 90° by activating pneumatic cylinder 119, the rectangular cam 147 engages the circular flange 49 in the circular ring 67 as shown in FIG. 7. The substantially rectangular cam 147 is designed so that when the cam surface is in the position shown in FIG. 7, the cam surface will engage the circular ring 67 and move the cylindrical drum 63 in a direction away from the circular flange 49. This movement of the cylindrical drum 63 compresses the springs 97 that are positioned in the passageways 75 in the cylindrical drum 63.

Figure 6:
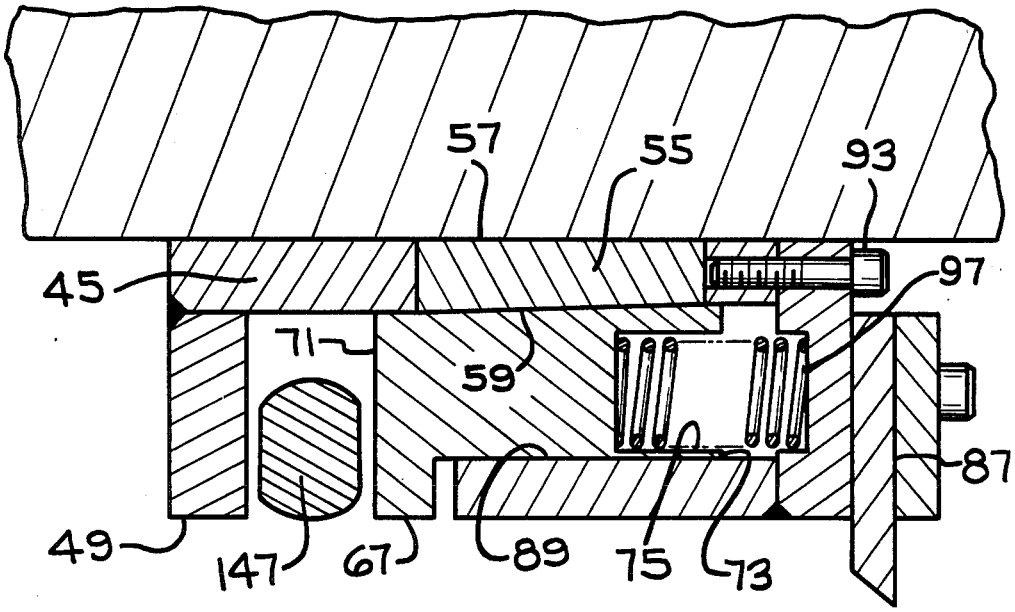
FIG. 6 is a cross-sectional view taken along line 6—6 in FIG. 2.
Figure 7:
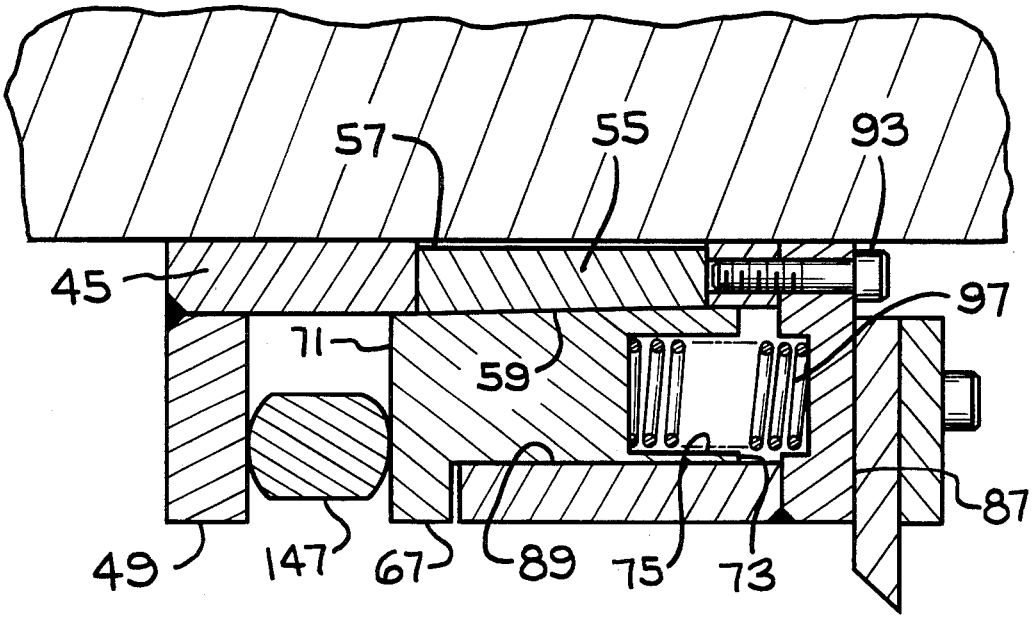
FIG. 7 is a cross-sectional view taken along line 7—7 in FIG. 2.

When the rotatable member 145 and the cam 147 are in the position shown in FIG. 6, the springs 97 will act against the cylindrical drum 63 so that the tapered interior surface 77 engages the outer surface 59 of the wedge members 55. The cooperating tapered surfaces of the interior surface 77 of the cylindrical drum 63 and the outer surface 59 of the wedge member 55 will cause the wedge members 55 to be forced into engagement with the rotatable shaft 9. The engagement of the interior surface 77 with the wedge members 55 retards the advancement of the cylindrical drum 63 towards the circular flange 49 on the cylindrical sleeve 45. The engagement of the wedge members or clamping shoes 55 with the rotatable shaft locks the hub 41 on to the rotatable shaft and maintains the cutting heads 15 and cooperating heads 17 in the desired location on the rotatable shaft. When the rotatable members 145 has been rotated substantially 90° to the position shown in FIG. 7, the substantially rectangular cam 147 will act against the circular ring 67 in a manner to move the cylindrical drum 63 in a direction away from the circular flange 49. When the cylindrical drum 63 moves to the position shown in FIG. 7, the interior surface 77 of the cylindrical drum no longer wedgingly holds the wedge member 55 against the rotatable shaft. Thus, the hub 41 is no longer secured to the rotating shaft and the hub 41 and the cooperating cutting and cooperating heads connected to the hub 41 are free to be moved axially along the rotatable shaft 9. When the cylindrical drum 63 is in the position shown in FIG. 7, the springs 97 are compressed against the face plate 87 of the cylindrical cover 81. When the rotatable member 145 is rotated back to the position shown in FIG. 6, the springs 97 act against the cylindrical drum 63 and cause the cylindrical drum to move back into the position shown in FIG. 6 where the interior surface 77 wedgingly engages the wedge members 55 against the rotatable shaft and secures the hub 41 to the rotatable shaft 9.

Figures 8, 9, 10:
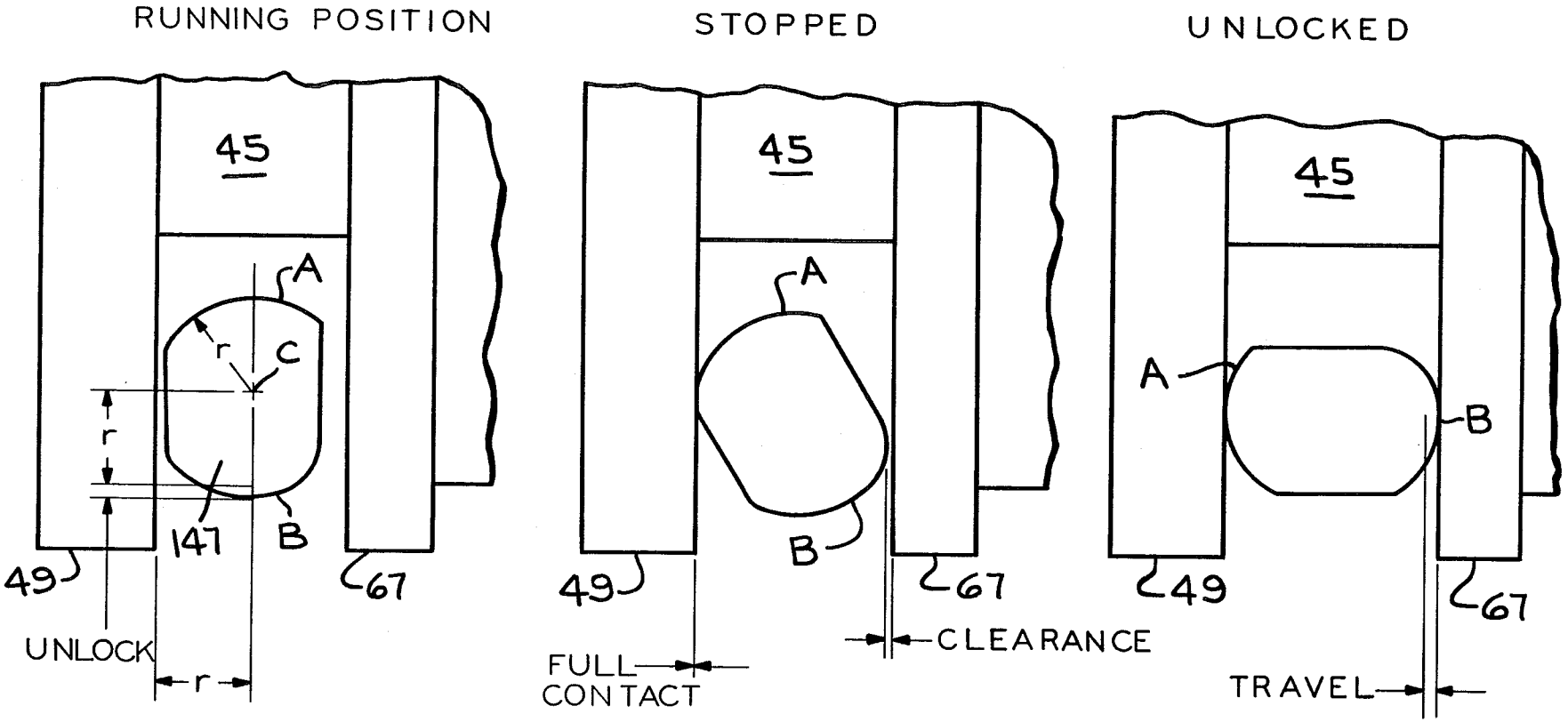
FIG. 8 is a cross-sectional view of a portion of the cutting device when in the running position.
FIG. 9 is a cross-sectional view of a portion of the cutting device when the device is in the stopped position.
FIG. 10 is a cross-sectional view of a portion of the cutting device when the cutting heads or rollers are in the unlocked position.

As shown in FIG. 8, the cam 147 has a preferable configuration to properly engage the circular flange 49 and to movingly engage the circular ring 67. The circular flange 49 and the circular ring 67 are spaced apart approximately a distance of 2r. The centerpoint c of the cam surface is positioned substantially midway between the circular flange and the circular ring. The portion of the cam surface adjacent the cylindrical sleeve 45 (in FIG. 8) is formed with a radiused or curved surface A. The radius of this curved surface is substantially one-half of the distance between the circular flange 49 and the circular ring 67 or the distance r. The portion of the cam surface spaced apart from the cylindrical sleeve 45 (in FIG. 8) has a radiused or curved surface B. The radius of this curved surface is slightly greater than one-half of the distance between the circular flange 49 and the circular ring 67 or slightly greater than the distance r. The curved surface A is disposed for engaging the circular flange 49 and the curved surface B is disposed for engaging the circular ring 67 when the cam 147 is rotated as shown in FIGS. 9 and 10.

A control panel 163 is positioned adjacent to the cutting device 1. The control panel has an outer cover 165 and a cover switch 167 positioned adjacent the opening edge of the outer cover 165. The cover switch 167 is disposed so that the switch engages the edge of the outer cover when the cover is closed on the control panel 163. When the outer cover 165 is swung to the open position, the switch 167 also moves to the open position. Essentially the outer cover 165 acts as a means to maintain the cover switch 167 in the closed position. Once the outer cover is moved to the open position, the cover switch 167 also moves to the open position. The cover switch 167 is operatively connected to the pneumatic cylinder 119 that is associated with the release mechanism 117 and controls the operation of the pneumatic cylinder. A plurality of control switches 171 are positioned in the control panel 163 beneath the outer cover 165. Each control switch 171 is operatively connected to a drive motor 30 for the first and second threaded rods. The control switches are oriented so that one switch will control the rotation of the upper and lower first threaded rod 27 located on one side of the outer housing 3 and another switch will control the upper and lower second threaded rod 28 located one side of the outer housing 3. Two control switches 171 can control the rotation of the first and second threaded rods located on one side of the outer housing 3 and two additional switches can control the rotation of the first and second threaded rods located on the other side of the outer housing 3. Thus, four control switches 171 can control the movement of the moveable cutting and cooperating heads shown in this particular embodiment of the cutting device.

In operation corrugated material, usually for boxes, will be fed between the rotatable shafts 9 so that the cutting heads 15 and cooperating heads 17 will engage the corrugated material to produce a cut or score therein.

To move the cutting heads and cooperating heads, the outer cover 165 on the control panel 163 is opened. The opening of the cover panel will activate the cover switch 167 that is positioned to be engaged by the outer cover 165. When cover switch 167 is activated by opening the outer cover 165 the pneumatic cylinder 119 is activating and the rod 121 is advanced in a direction away from the pneumatic cylinder 119. The rod 121 is operatively connected to the first gear rack 127 and the second gear rack 137. The movement of the rod 121 causes the first and second gear racks to also move in a direction away from the pneumatic cylinder 119. The gear teeth 129 on the first gear rack and the gear teeth 139 on the second gear rack 137 engage gear teeth 151 that are located on partial gear 149 that are mounted on rotatable members 145. The rod 121 of the pneumatic cylinder 119 is desired to advance the first and second gear racks a distance that is sufficient to rotate the rotatable members 145 approximately 90°. Rotation of the rotatable members 145 causes the cam 147 located on the end of the rotatable member 145 that is opposite to the end where the partial gear 149 is located to also rotate approximately 90°. The cam surface A engages the circular flange 49. This holds the heads including the rollers. The cam surface B next engages the circular ring 67 on the cylindrical drum 63. This compresses the springs 97 and the hub assembly 41 is now in the unlocked position in FIG. 10. When in the unlocked position the heads may be moved laterally along the shafts to the new predetermined position.

During unlocking, the movement of the cylindrical drum 63 causes the interior surface 77 of the drum to move over the outer surfaces 59 of the wedge members 55. Due to the tapered cross-sectional configuration of the interior surface 77 of the cylindrical drum 63 and the outer surfaces 59 of the wedge members 55, the wedge members are no longer held into locking engagement with the rotatable shaft 9 upon which a respective head including the hub assembly 41 is mounted. The hub assembly 41 is free to be moved in an axial direction along the rotatable shaft until reaching the new position.

Actual movement of the cutting heads 15 and cooperating heads 17 is accomplished by rotating the threaded rods 27 and 28. These rods are rotated by drive motors 30 and the drive motors are operatively connected to control switches 171 located in the control panel 163. The control switches 171 are toggle-type switches. Moving the switch in one direction causes the control motor to rotate the threaded rod in one direction, while moving the switch in the opposite direction causes the threaded rod to rotate in the opposite direction. The plate 33 having threaded collar 34 is disposed on the moveable flange 19 in a manner to engage either the first or second threaded rod. In any event, moving the control switches 171 in the appropriate manner causes the respective threaded rod to rotate in the desired direction and this causes the moveable flange 19 to move in the desired direction. Because the rotatable members 145 of the release mechanism 117 are connected to the flanges 19 and the rotatable members extend between the circular flange 49 and circular ring 67 of the hub assembly 41 for the cutting and cooperating rollers, movement of the flanges positions the cutting and cooperating heads in the desired location on the rotatable shafts 9.

Because the first rotatable rod that is positioned adjacent the cutting head 15 is operatively connected to the first rotatable rod that is positioned adjacent the cooperating head 17, the first rotatable rods on one side of the device 1 rotate simultaneously and this results in a substantially uniform movement for the cutting head 15 and cooperating head 17. In a like manner, the second threaded rods 28 are operatively connected together and simultaneously move a different pair of cutting and cooperating heads. This arrangement is the same on the opposite side of the cutting device 1, which is essentially a mirror image of the previously discussed apparatus. Accordingly, four control switches can be used to move the four cooperating cutting and cot heads that are positioned on the rotating shafts 9. It should be understood that by moving the control switches 177 in the desired direction, the cooperating cutting and cot heads can be positioned at almost any point along the rotating shafts 9.

Once the cutting and cooperating heads are in the desired position, the outer cover 165 on the control panel 163 is closed. This again activates the cover switch 167 which is operatively connected to the pneumatic cylinder 119. When the outer cover 165 is closed, the rod 121 of the pneumatic cylinder 119 is caused to advance in a direction away from the rotatable members 145. This causes the first gear rack 127 and second gear rack 137 to advance in a direction towards the pneumatic cylinder. Since the gear teeth 129 and gear teeth 139 on the first and second gear racks respectively engage the gear teeth 151 on the partial gears 149 connected to the rotatable members 145, this movement of the rod 121 causes the rotatable members 145 to move back to the position shown in FIG. 3. This movement of the rotatable members 145 causes the cam 147 to return to the position shown in FIG. 6. As the cam 147 is no longer engaging the circular ring 67 of the cylindrical drum 63, the springs 97 will bias the cylindrical drum 63 back to the position shown in FIG. 6. In this position, the wedge members 55 in the cylindrical sleeve 45 are wedgingly secured against the rotatable shaft 9 and the hub assembly 41 is secured to the rotatable shaft 9.

The above detailed description is for the sake of explanation. Various modifications and substitutions, other than those cited, can be made without departing from the scope of the following claims.

What I claimed is:

1. A cutting device comprising:

opposed rotatable shafts;

cutting and cooperating heads positioned on said shafts, said heads being disposed for cutting or scoring material passed through said heads;

a hub assembly connected to at least one of said heads, said hub assembly positioned on said rotatable shaft and releasably securing said head to said shaft; said hub assembly locking said head on said shaft;

said hub assembly including at least one wedge member, a rotatable member positioned adjacent said hub assembly, said rotatable member being rotatable to engage said hub assembly, said hub assembly including a sleeve positioned on said shaft, said sleeve mounting said wedge member, and means adjacent said wedge member and operatively connected to said rotatable member for engaging sand disengaging said wedge member wherein said heads can be repositioned along said shafts.

2. The cutting device of claim 1, wherein said sleeve comprises a cylindrical sleeve having an outer surface, said sleeve defining a center aperture, one of said shafts extending through said aperture, at least one opening being positioned in said outer surface of said sleeve, said wedge member being moveably positioned in said opening, said wedge member disposed for contacting said shaft to secure said head to said shaft, said wedge member having a tapered cross-section.

3. The cutting device of claim 2, wherein said engaging and disengaging means includes a cylindrical drum having a center passageway positioned concentrically around said cylindrical sleeve, said cylindrical drum having a tapered interior surface, said tapered surface of said cylindrical drum contacting said wedge member in said cylindrical sleeve to urge said wedge member into contact with said shaft to secure said cylinder sleeve on said shaft.

4. The cutting device of claim 3, wherein said cylindrical drum is moveably positioned around said cylindrical sleeve, said cylindrical drum being biased in a direction so that said tapered interior surface of said drum urges said wedge member into contact with said shaft.

5. The cutting device of claim 4, wherein a cylindrical cover is positioned coaxially around said cylindrical drum, said cover being secured to said cylindrical sleeve, said head being positioned on the end of said cover that is spaced apart from said cylindrical sleeve.

6. The cutting device of claim 5, wherein said cylindrical cover has an end wall that is spaced apart from said cylindrical sleeve, at least one resilient member positioned between said end wall and said cylindrical drum, said resilient member acting to bias said cylindrical drum in a direction away from said end wall so that said tapered interior wall of said cylindrical drum acts against said tapered surface of said wedge member to urge said wedge member against said shaft to secure said cylindrical sleeve, drum and cover to said shaft.

7. The cutting device of claim 6, wherein said cylindrical sleeve has a flange that extends from said sleeve in a direction that is perpendicular to said axis of said center aperture, said cylindrical drum having a rim that extends from said drum in a direction perpendicular to said axis of said center passageway, said flange and said rim being disposed in parallel opposed and spaced apart relationship.

8. The cutting device of claim 7, wherein said rotatable member is positioned between said flange on said cylindrical sleeve and said rim on said cylindrical drum, said rotatable member defining at least one cam surface, said rotary cam engaging said cylindrical drum and moving said drum towards the end wall of said cylindrical cover when said rotary cam is in a rotated position; said movement of said drum causing said tapered interior surface of said drum to move relative to said tapered surface of said wedge so that said wedge is no longer urged into contact with said shaft, wherein said head can be moved on said shaft.

9. The cutting device of claim 8, wherein said rotatable member is operatively connected to a device for rotating said rotatable member to move said cam surface between engaged and disengaged positions.

10. The cutting device of claim 9, wherein said rotatable member has a gear disposed thereon, said gear matingly engaging a moveable gear rack, said gear rack being disposed so that movement of said gear rack will cause said gear and said rotatable member to rotate and move said rotary cam between said engaged and disengaged positions.

11. The cutting device of claim 10, wherein a pneumatic cylinder having a moveable rod is operatively connected to said gear rack, activation of said pneumatic cylinder causing said movable rod to advance whereby said moveable rod causes said gear rack to advance to rotate said rotary cam.

12. The cutting device of claim 11, wherein a moveable flange is positioned adjacent each of said heads, said pneumatic cylinder, said rotatable member and said gear rack being connected to said moveable flange.

13. The cutting device of claim 12 wherein said moveable flange has a threaded aperture and a rotatable threaded rod is positioned in said aperture and engages said threads in said threaded aperture whereby said moveable flange will be caused to move by rotation of said threaded rod.

14. The cutting device of claim 13 wherein a drive motor is operatively connected to said threaded rod rotating said rod and causing said moveable flange to advance along said rod.

15. The cutting device of claim 14 wherein a control device is connected to said drive motor for controlling the operation of said motor for rotating said threaded rod, said control device being located adjacent a switch that activates said pneumatic cylinder, said control device being exposed for activating said drive motor when said switch for said pneumatic cylinder has been opened so that said pneumatic cylinder has been activated to advance said gear rack and to rotate said rotatable member so that said hub assembly is released and said head is free to move on its rotatable shaft.

16. A cutting device comprising:

opposed rotatable shafts;

heads positioned on said shafts, said heads being disposed for cutting or scoring material passed through said cutting heads;

a cylindrical sleeve connected to each of said heads, said sleeve defining a center aperture, said shaft extending through said aperture, at least one opening being positioned on said sleeve, a wedge member being moveably positioned in said opening, said wedge member disposed for contacting the surface of said shaft to secure said head to said shaft, said wedge member having a tapered cross-section;

a cylindrical drum having a center passageway moveably positioned concentrically around said cylindrical sleeve, said cylindrical drum having a tapered interior surface, said tapered surface of said cylindrical drum contacting said wedge member in said cylindrical sleeve to urge said wedge into contact with said shaft to secure said cylindrical sleeve on said shaft;

a cylindrical cover positioned coaxially around said cylindrical drum, said cover being secured to said cylindrical sleeve, said head being positioned on end of said cover, said cylindrical cover having an end wall that is spaced apart from said cylindrical sleeve, at least one resilient member positioned between said end wall and said cylindrical drum, said resilient member acting to bias said cylindrical drum in a direction away from said end wall so that said tapered interior wall of said cylindrical drum acts against said tapered surface of said wedge member to urge said wedge member against said shaft to secure said cylindrical sleeve, drum and cover to said shaft;

a flange extending from said cylindrical sleeve in a direction that is perpendicular to said axis of said center aperture;

a rim extending from said cylindrical drum in a direction perpendicular to said axis of said center passageway, said flange and said rim being disposed in parallel opposed and spaced apart relationship;

at least one rotatable member positioned between said flange on said cylindrical sleeve and said rim on said cylindrical drum, said rotatable member having a first end positioned between said flange and said rim, said first end defining a substantially rectangular rotary cam, said rotary cam having a first and second position, said rotary cam not contacting said flange or said rim when said cam is in said first position, said rotary cam surface engaging said cylindrical drum and moving said drum towards the end wall of said cylindrical cover when said rotary cam is in said second position; said movement of said drum when said rotary cam is in the second position causing said tapered interior surface of said drum to move relative to said tapered surface of said wedge member so that said wedge member is no longer urged into contact with said shaft and said head can be moved on said shaft.

17. The cutting device of claim 16, wherein said second end of said rotatable member is operatively connected to a device for rotating said rotatable member to move said rotary cam on said first end from said first position to said second position.

18. The cutting device of claim 17, wherein said second end of said rotatable member has a gear disposed thereon, said gear matingly engaging a moveable gear rack, said gear rack being disposed so that movement of said gear rack will cause said gear on said second end and said rotatable member to rotate and move said rotary cam on said first end of said rotatable member from said first to said second position.

* * * * *